US008321967B2

(12) United States Patent
Mesun et al.

(10) Patent No.: US 8,321,967 B2
(45) Date of Patent: Dec. 4, 2012

(54) WALL INSTALLED TOILET

(75) Inventors: Randy O. Mesun, Sheboygan, WI (US); Daniel N. Halloran, Saukville, WI (US)

(73) Assignee: Kohler Co., Kohler, WI (US)

( * ) Notice: Subject to any disclaimer, the term of this patent is extended or adjusted under 35 U.S.C. 154(b) by 755 days.

(21) Appl. No.: 12/184,593

(22) Filed: Aug. 1, 2008

(65) Prior Publication Data

US 2010/0024115 A1 Feb. 4, 2010

(51) Int. Cl.
*E03D 11/00* (2006.01)

(52) U.S. Cl. ..... 4/420

(58) Field of Classification Search ..... 4/420–421
See application file for complete search history.

(56) References Cited

U.S. PATENT DOCUMENTS

| | | | | |
|---|---|---|---|---|
| 381,660 | A | | 4/1888 | Wells |
| 502,452 | A | | 8/1893 | Wells |
| 1,996,693 | A | | 4/1935 | Wallace |
| 2,213,394 | A | | 9/1940 | Hoffmann |
| 2,875,453 | A | | 3/1959 | Baker et al. |
| 2,878,483 | A | | 3/1959 | Schmid |
| 3,124,809 | A | | 3/1964 | Schmid |
| 3,271,793 | A | | 9/1966 | McMurtrie et al. |
| 3,273,173 | A | | 9/1966 | Morris et al. |
| 3,419,911 | A | | 1/1969 | Wood |
| 3,576,038 | A | | 4/1971 | Dirks et al. |
| 3,591,868 | A | | 7/1971 | Owens |
| 3,686,695 | A | | 8/1972 | Mielback et al. |
| 4,944,047 | A | | 7/1990 | Gagliano |
| 4,970,732 | A | | 11/1990 | Deng |
| 5,090,064 | A | | 2/1992 | Breitenberger |
| 5,148,552 | A | | 9/1992 | Kress et al. |
| 5,150,480 | A | | 9/1992 | Schmucki |
| 5,163,186 | A | | 11/1992 | Dolder |
| 5,165,457 | A | | 11/1992 | Olin et al. |
| 5,167,040 | A | | 12/1992 | Lechner |
| 5,210,883 | A | | 5/1993 | Weber et al. |
| 5,502,845 | A | * | 4/1996 | Hayashi et al. ..... 4/300 |
| 5,666,675 | A | | 9/1997 | Ruegg |
| 5,765,237 | A | | 6/1998 | Okamoto et al. |
| 5,926,863 | A | * | 7/1999 | Arita et al. ..... 4/425 |
| 6,000,070 | A | | 12/1999 | Bonin |
| 6,035,589 | A | | 3/2000 | Schmucki et al. |
| 6,062,253 | A | | 5/2000 | Hanel et al. |
| 6,128,787 | A | | 10/2000 | Krist et al. |
| 6,301,838 | B1 | | 10/2001 | Hall |
| 6,367,095 | B2 | | 4/2002 | Hubatka et al. |

(Continued)

FOREIGN PATENT DOCUMENTS

| | | |
|---|---|---|
| CA | 2 370 152 | 11/2001 |

(Continued)

OTHER PUBLICATIONS

Eight pages of a PCT search report of PCT/US2009/004339 dated Nov. 9, 2009 in a corresponding PCT application.

*Primary Examiner* — Lori Baker
(74) *Attorney, Agent, or Firm* — Foley & Lardner LLP

(57) ABSTRACT

Disclosed are toilets suitable to be installed partially behind a bathroom wall. In some embodiments a siphon leg of the toilet trapway extends sideways between lateral studs of the wall. Thus, an elongated trapway can be accommodated without needing to position the siphon leg in the bathroom or behind the wall studs. In other embodiments the tank for the toilet is also positioned between studs of the room wall.

20 Claims, 4 Drawing Sheets

U.S. PATENT DOCUMENTS

| | | | | |
|---|---|---|---|---|
| 6,415,457 | B2 | 7/2002 | Schmucki | |
| 6,496,989 | B1 | 12/2002 | Meiser | |
| 6,643,865 | B2 | 11/2003 | Bork et al. | |
| 6,757,918 | B2 | 7/2004 | Hoegger | |
| 6,910,231 | B2 | 6/2005 | Breiing et al. | |
| 6,928,669 | B2 | 8/2005 | Akin | |
| 7,020,908 | B2 * | 4/2006 | Kuru et al. | 4/420 |
| 7,272,864 | B2 | 9/2007 | Grob et al. | |
| 2003/0213055 | A1 | 11/2003 | Yoneda et al. | |
| 2005/0268391 | A1 | 12/2005 | Reichmuth et al. | |
| 2007/0113331 | A1 | 5/2007 | Prokopenko et al. | |
| 2007/0169257 | A1 | 7/2007 | Van Herp et al. | |

FOREIGN PATENT DOCUMENTS

| | | |
|---|---|---|
| DE | 2500889 | 7/1976 |
| EP | 1275787 | 1/2003 |
| FR | 2349690 | 11/1977 |
| GB | 452339 | 8/1936 |
| GB | 708454 | 5/1954 |
| GB | 2110260 | 6/1983 |
| GB | 2368352 | 5/2002 |
| NE | 1024544 | 4/2005 |
| WO | WO 00/66841 | 11/2000 |
| WO | WO 2008/041048 | 4/2008 |

* cited by examiner

WALL INSTALLED TOILET

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The invention relates to toilets having a portion (e.g. particularly part of a siphon trap) installed behind a room wall.

In many bathrooms space is a valuable commodity. When a bath, a toilet, and a vanity are all placed in a conventionally sized bathroom, most of the floor space is quickly used up.

Typically, toilets have had a footprint defined by the space needed to accommodate the bowl/seat, a water storage tank, and a trapway extending from the bowl. In particular, conventional trapways extend up from the bottom of the bowl to a weir, then down via a siphon formation leg, and then typically transversely to a sewer outlet. This takes up a considerable portion of the needed footprint for a toilet.

The trapway serves multiple purposes including trapping sewer gas by formation of a water seal, retaining water in the bowl prior to flushing, and assisting in the formation of a siphon during the flush cycle. The shape of the trapway can be critical to performance of the toilet in terms of cleaning ability and water use.

There have been some attempts to minimize the footprint of a toilet in a bathroom by forming convoluted trapways which do not go as far rearward as conventional trapways. See e.g. U.S. Pat. Nos. 381,660 and 502,452. However, this type of construction of the trapway creates inefficiencies and complicates production.

Others have attempted to place a portion of the trapway behind the room wall so that less of the toilet extends into the room to take up room space. See e.g. U.S. Pat. Nos. 2,878,483, 3,271,793 and 6,415,457. However, such in-wall trapways have not taken optimal advantage of the space behind the room wall, and have created their own inefficiencies in operation.

Hence, a need exists for toilets which reduce the room footprint thereof in an efficient manner while still providing equal or better performance over conventional wash down toilets.

SUMMARY OF THE INVENTION

The present invention provides a toilet suitable to be installed through a bathroom wall such that part of the toilet is in front of the bathroom wall and another part of the toilet is behind the bathroom wall. In one form the toilet includes a bowl portion suitable to be positioned in the bathroom in front of the bathroom wall and a trap with an up leg connecting the bowl with a weir portion of the trap and a siphon creating portion extending down from the weir.

The siphon creating portion has a first path positionable behind the bathroom wall suitable to direct water sideways in one direction and a second path suitable to thereafter direct that water in a sideways direction opposite to said one direction. The structure of the trap is such that during the flush cycle the formation of the siphon occurs proximate the intersection of the first path and the second path.

An outlet may be formed at a down stream end of the second path. The outlet may be aligned along a central longitudinal axis of the toilet bowl.

According to another aspect of the invention, the first path may extend both downwardly and sidewardly in a sloping fashion, or an outlet may be formed adjacent, but not at, a downstream end of the second path. Further, an accumulation toe area may be formed at the downstream end of the second path.

According to still another aspect of the invention, the first and second paths may be formed along a bell shaped down leg of the trap.

According to another aspect of the invention, the toilet bowl may be made from a ceramic material, and the first and second paths may be made from a non-ceramic material. The first and second paths may be formed in a unitary plastic structure.

In another form the toilet includes a bowl portion suitable to be positioned in the bathroom in front of the bathroom wall. The toilet further includes a trap with an up leg connecting the bowl with a weir portion of the trap and a siphon creating portion extending down from the weir. The siphon creating portion has a first vertical path outside the bathroom wall that extends from the weir along a central axis of the bowl, and a second path positionable inside the bathroom wall in the form of a foot that directs water in a sideways direction.

According to one aspect of the invention, the bathroom wall may be a skirt portion of a bathroom floor, the first path may be outside the bathroom wall, and the second path may extend in an essentially horizontal direction.

According to other aspects of the invention, the bowl may be made from a ceramic material, and the first and second paths may be made from a non-ceramic material. The first and second paths may be formed in a unitary plastic structure.

The present invention additionally provides a toilet installed through a bathroom wall such that part of the toilet is in front of the bathroom wall and another part of the toilet is behind the bathroom wall between adjacent studs of the wall. The toilet includes a bowl portion positioned in the bathroom in front of the bathroom wall. The toilet further includes a trap having an up leg connecting the bowl with a weir portion of the trap and a siphon creating portion extending down from the weir. The siphon creating portion has a first path suitable to direct water sideways in one direction behind the bathroom wall and a second path suitable to thereafter direct that water in a sideways direction opposite to one said direction.

According to one aspect of the invention, the studs are preferably 2×4 inches and are between twelve inches and sixteen inches apart.

Thus, the present invention provides a toilet where a significant part of the trapway can be behind the room wall (preferably between adjacent wall studs). Thus, the footprint of the toilet is reduced.

Importantly, the fact that the trap has portions of it extending sideways between the studs prevents the need for the toilet to use up extra space behind the studs. Most preferably, the trapways efficiently utilize the otherwise wasted lateral space between the studs of the wall to increase an effective length of the "down" leg and the "out" leg.

Further, production is simplified as the more convoluted trapway parts that go behind the room wall don't need to be made of the same material as the main bowl, and in fact can be made separately. Moreover, additional space between the studs can be used for mounting a tank if desired, further improving the room aesthetics.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
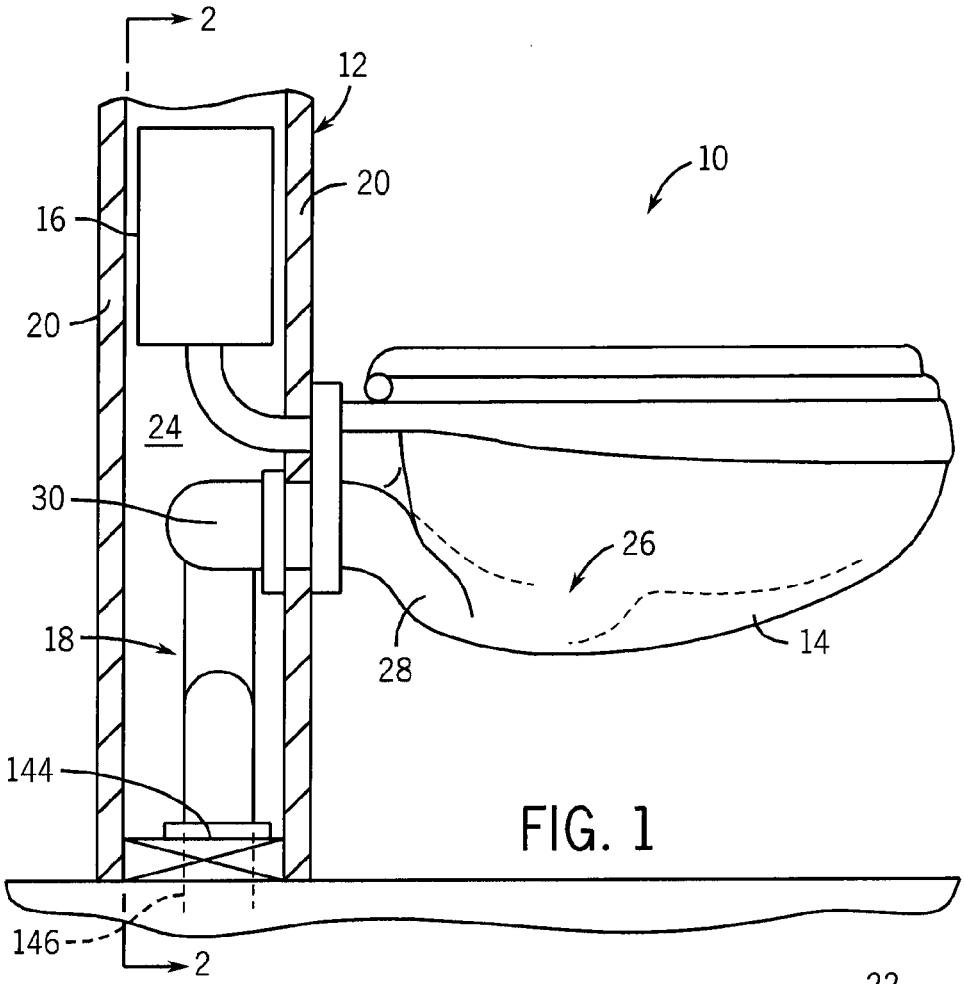
FIG. 1 is a side view of one form of a toilet of the present invention.
Figure 2:
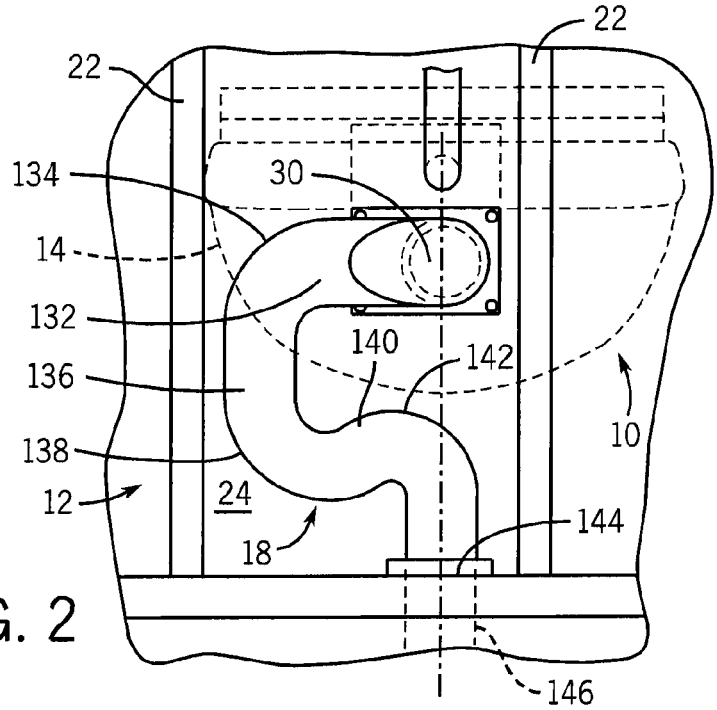
FIG. 2 is a view taken along line 2-2 of FIG. 1.

Referring now to FIGS. 1 and 2, a wall-hung type toilet 10 is shown having a rearward portion installed behind the frontal portion of room wall 12. Toilet 10 includes a bowl 14 that is positioned in front of the wall 12, a tank 16 positioned behind that wall, and a trapway 18 extending from the bottom of the bowl 14 to a waste line 146.

There are a pair of drywall sheets 20 separated and supported by a pair of studs 22 defining a cavity 24 therebetween. The studs 22 may be any kind of studs. However, it is preferred that they be the usual 2×6 studs conventionally used in drywall construction. It is contemplated that 2×4 studs or other stud sizes could also be used to construct the wall.

With the present invention tank 16 may be located as shown in wall cavity 24. However, the tank 16 may alternatively be located within the bathroom (compare FIG. 3).

Notably, the trapway 18 includes a section that is behind frontal wall 12, most preferably inside the wall cavity 24. The trapway 18 extends back from an opening 26 in the bottom of the bowl 14 along an up leg 28. The up leg 28 then peaks at a weir 30, preferably near one of the sheets 20. The weir 30 then extends through one of the sheets 20 such that the trapway 18 enters the wall cavity 24.

The trapway 18 then has a siphon creating portion that extends down from the weir 30. In the embodiment shown in FIGS. 1 and 2, the siphon creating portion of the trapway 18 is generally C-shaped in rear view. After entering the wall cavity 24, the weir 30 extends sideways along a sideways-extending leg 132 towards one of the pair of studs 22. As the trapway 18 approaches that stud 22, it transitions at an upper bend 134 into a down leg 136.

The down leg 136 extends downwards to a heel 138, at which point the down leg 136 begins to extend sideways as an out leg 140. The out leg 140 has an upwardly bending portion 142 that, in some configurations, may extend upward far enough to act as a second weir. The out leg 140 bends down to an outlet 144 that connects to the waste line 146. The outlet 144 is aligned along a central longitudinal axis of the toilet 10 and located directly below the weir 30.

Hence, the space between the studs is used to provide this trapway with room to efficiently operate. When the toilet 10 is between flush cycles, the bowl 14 is filled with water and a water seal is formed by water filling the up leg 28 up to the weir 30. This water seal prevents the flow of sewer gases from the waste line out of the opening 26 of the bowl 14 and into the surrounding atmosphere.

When the toilet 10 is flushed, a siphon is formed in the siphon creating portion of the trapway 18. First, water from the tank 16 (or other water source), is supplied to the bowl 14. This quickly increases the amount of water in the bowl 14 and raises the water level in the up leg 28 over the weir 30 and into the lower portions of the trapway 18 (i.e., the sideways-extending leg 132, the upper bend 134, the down leg 136, the heel 138, and the out leg 140). The water may corkscrew as it bends at the top of weir 30 and travels through the sideways-extending leg 132 and the down leg 136 to the heel 138. In the area of the heel 138 and the upwardly bending portion 142 of the out leg 140, a siphon is induced.

Notably, both the corkscrew pattern of the water and the sudden redirection of the water at the heel 138 assist in the induction of the siphon. Creation of a strong siphon is promoted, since much of the water is below the weir 30 at the time and location of siphon formation. Due to the strong siphon action, it is contemplated that a water jet may not be necessary to form the siphon. However, a water jet may also be incorporated into the toilets described herein.

Conceptually, the siphon creating portion after the weir can be understood to be a first path that extends sideways and a second path that extends sideways opposite the first path. When the water first flows through the intersection between the two paths, the flow of the water slows and a siphon is induced. At the down stream end of the second path, the outlet directs the waste water into the waste line.

As the first and second paths extend, at least in part, laterally in the wall cavity 24, the length of the siphon creating portion of the trapway 18 is increased, even though there is relatively little space within the wall cavity 24. The increased length of the trapway 18 before the point of siphon formation promotes the formation of a strong siphon.

Figure 3:
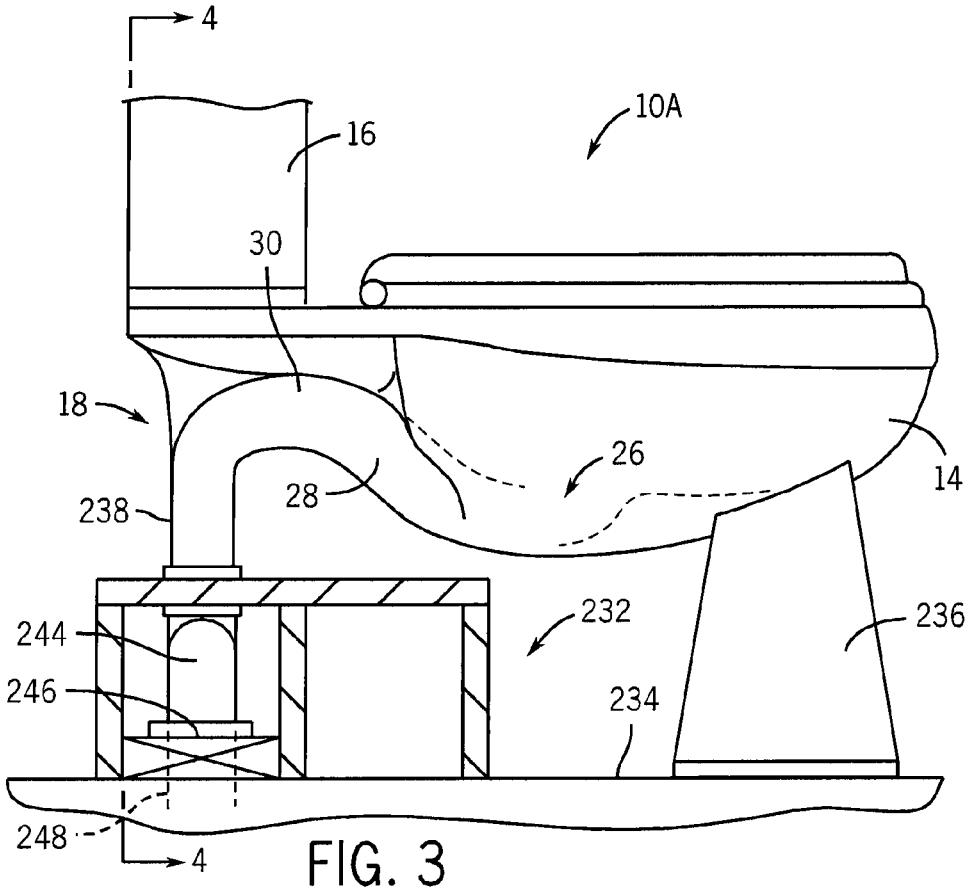
FIG. 3 is a side view of another form of the toilet in which an out leg extends horizontally under a skirt in the floor.
Figure 4:
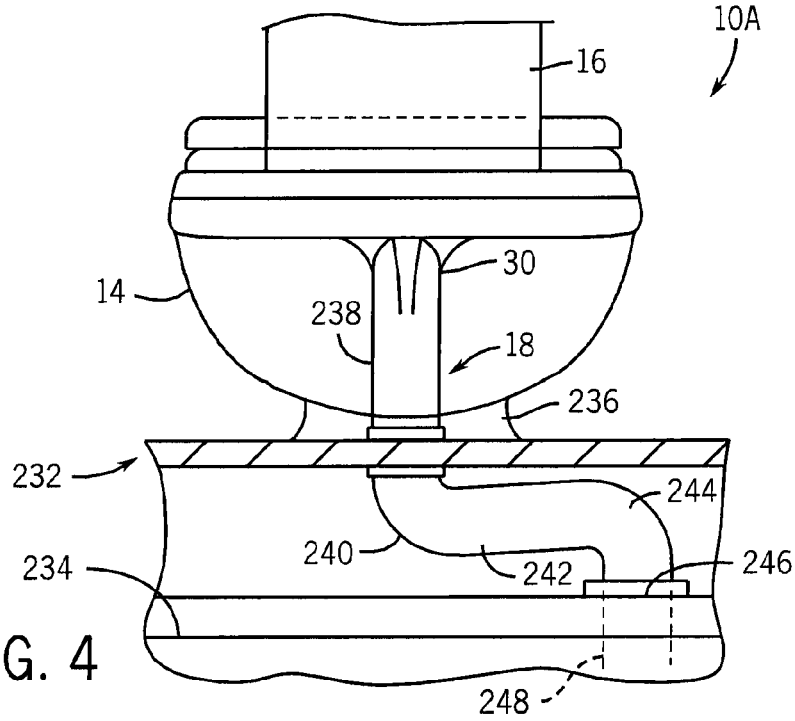
FIG. 4 is a view taken along line 4-4 of FIG. 3.

Referring next to FIGS. 3 and 4, another toilet 10A is shown having a portion of its trapway 18 concealed by a horizontally extending bathroom wall. In this form, the trapway 18 of the toilet 10A does not extend into a side wall of the bathroom, but rather into a skirt portion 232 of the floor 234. The skirt portion 232 is used to conceal a portion of the trapway 18. As shown, the toilet 10A has a base 236 that rests on the floor 234 to support the bowl 14.

In this form, the toilet 10A has an portion of the trapway 18 above and outside of the skirt portion 232. In particular, the exterior portion of the trapway 18 includes the up leg 28 which extends up to the weir 30 and transitions into a down leg 238. As shown, the down leg 238 extends vertically and along a central axis of the toilet 10A.

The down leg 238 extends into the skirt portion 232 of the floor 234. In the skirt portion 232, the down leg 238 transitions at a heel 240 into an out leg 242 or foot. The out leg 242 extends in a sideways direction away from the central axis of the toilet 10A. As shown, this sideways extension is lateral from the toilet 10A and in an essentially horizontal direction. The out leg 242 eventually has a bend 244 with an outlet 246 that can be connected to a waste line 248.

It is contemplated that the foot of the toilet may to extend in directions other than a direction perpendicular to the central axis of the toilet. The direction of foot extension may be restricted by the placement of studs in the skirt portion 232 of the floor 234 or by the location of the waste water pipe connection.

In operation, the toilet will work similar to a standard serpentine trapway with the siphon forming proximate the heel 240 between the down leg 238 and the out leg 242.

However, in this form, the water is directed sideways and away from the central axis of the toilet by the out leg instead of forwards towards the bowl. The sideways extension of the out leg 242 allows for a longer out leg, as the standard forward extension of the out leg is limited by the distance the toilet is placed from the wall. Moreover, as the out leg 242 is concealed by the skirt portion 232 of the floor 234, the length of the out leg 242 can be increased without having a portion of the trapway 18 extending across an exterior surface of the bathroom floor.

Although this embodiment shows the down leg 238 extending into a skirt portion 232 of the floor 234, it is contemplated that the down leg 238 could extend into a floor not having a skirt portion. In this form, once in the floor, the down leg 238 may extend away from the central axis of the toilet within the floor.

Figure 5:
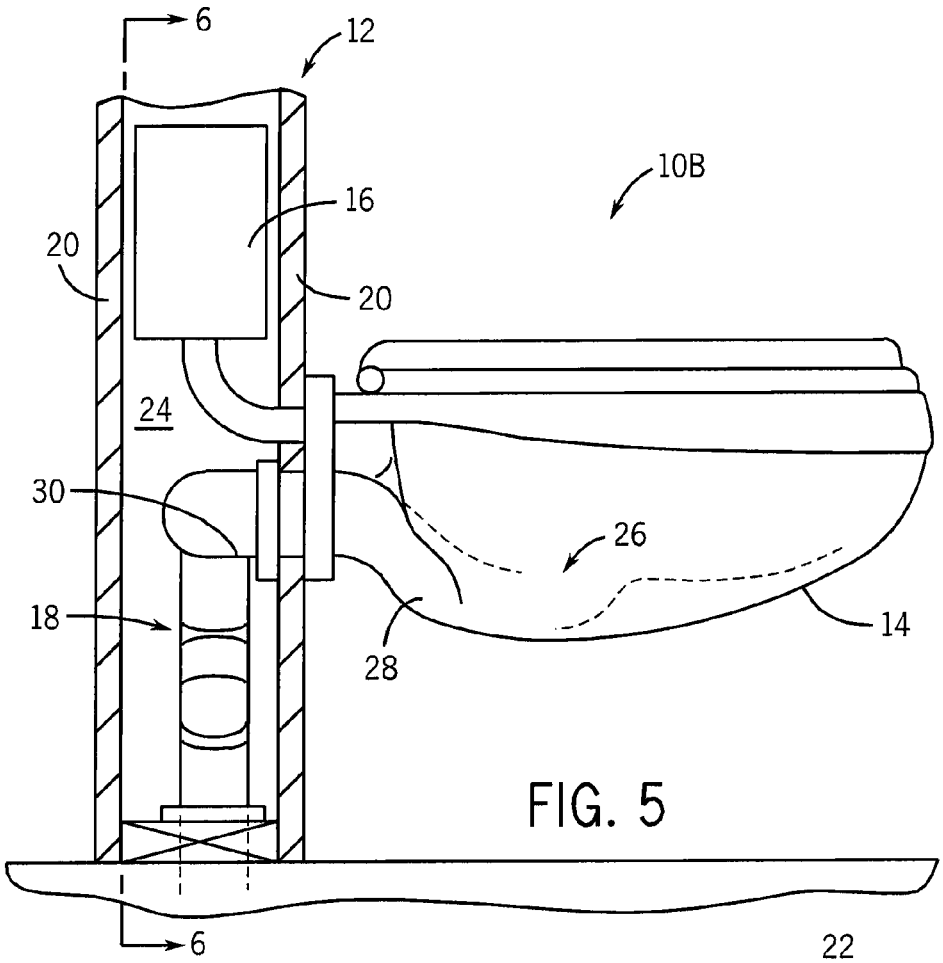
FIG. 5 is a view similar to FIG. 1 but of another embodiment.
Figure 6:
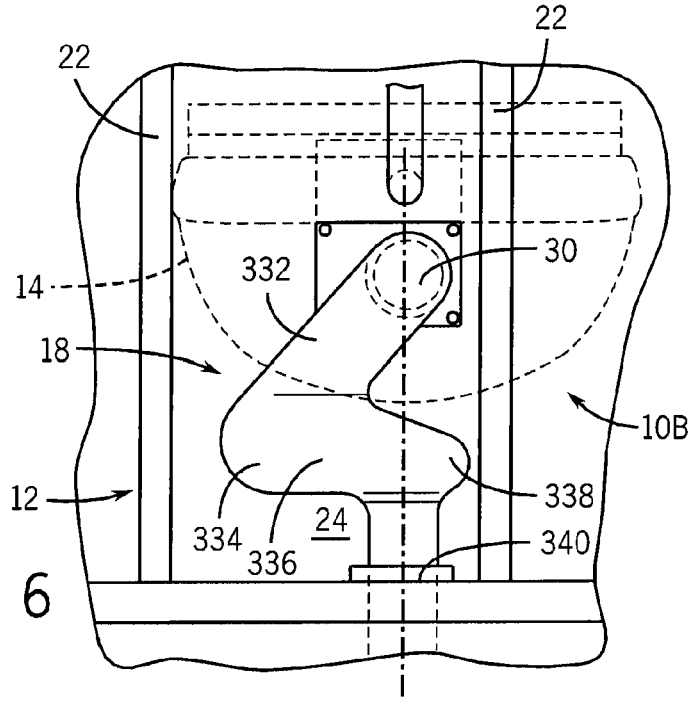
FIG. 6 is a view taken along line 6-6 of FIG. 5.

Referring next to FIGS. 5 and 6, a toilet 10B is shown which is analogous to that of FIG. 1, except that the toilet 10B has a different concealed portion of the trapway 18. In this form, the concealed portion of the trapway 18 has a diagonal down leg 332 that extends downwardly and sidewardly in sloping fashion from the weir 30. The diagonal down leg 332 has a heel or spoon section 334 that directs flushed water across a cross leg 336 to an accumulation toe area 338. Along the cross leg 336, and between the spoon section 334 and the accumulation toe area 338, an outlet 340 is formed. This out let is adjacent, but not at, a downstream end of the cross leg 336.

Upon flushing, a siphon is formed in the lower end of the concealed portion of the trapway 18. When the toilet 10B is flushed, the water is sent over the weir 30 and down and along a first path in the diagonal down leg 332. When the water enters the spoon section 334 at the bottom of the diagonal down leg 332, the water is redirected along a second path across the cross leg 336 (and over the outlet 340) into the accumulation toe area 338. The water collects between the accumulation toe area 338 and the spoon section 334 to seal the trapway 18. Once the water jumps across the cross leg 336, the stack continues to fill with water at a sufficient rate to initiate a siphon. Once the siphon is formed, the collected water will be pulled down the outlet 340 and into a waste line by the force of the siphon.

Figure 7:
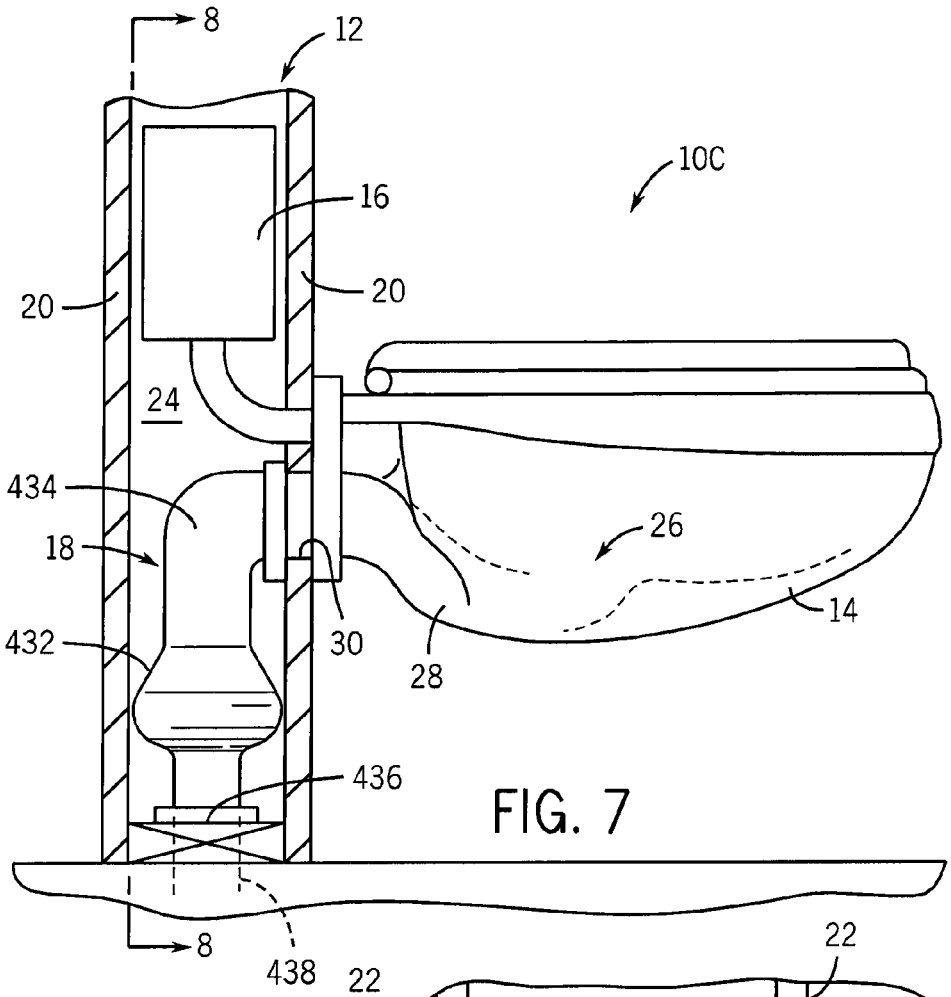
FIG. 7 is a view similar to FIG. 5, but of yet another embodiment.
Figure 8:
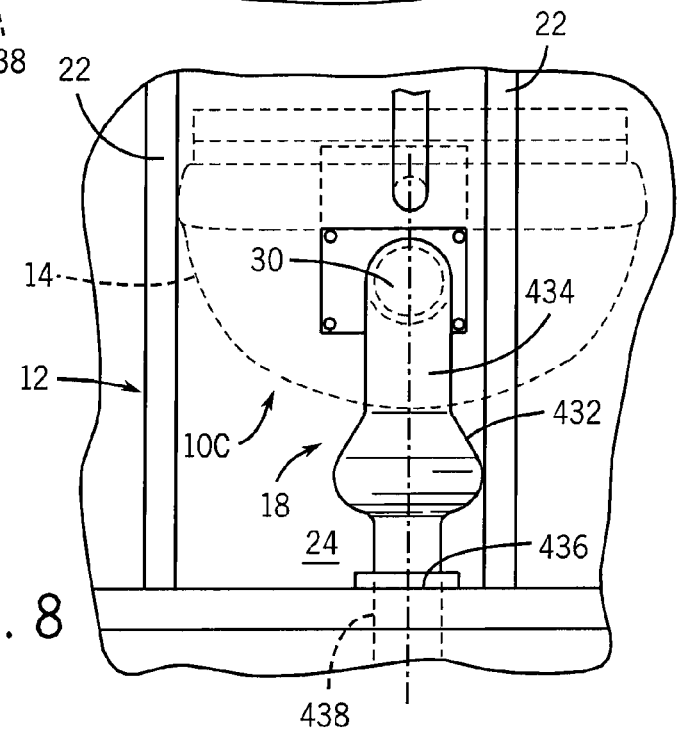
FIG. 8 is a view taken along line 8-8 of FIG. 7.

Referring next to FIGS. 7 and 8, a toilet 10C having a trapway 18 with a bell-shaped portion 432 is shown. Again, the toilet 10C has an up leg 28 extending from an opening of the bowl 14 to a weir 30 that extends from the outside of the toilet into the wall cavity 24. Once inside the wall cavity 24, the weir 30 extends into a down leg 434. The down leg 434 extends downwardly for a distance before extending gradually outwardly and then inwardly at the bell-shaped portion 432. The down leg 434 then continues downwardly to an outlet 436 that is connected to a waste water line 438. Thus, the bell-shaped portion 432 resembles a bell-shaped bulge along the pathway of the trapway 18.

The bell-shaped portion 432 assists in forming a siphon when the toilet 10C is flushed. When flushed, water flows over the weir 30 and down the down leg 434. As the water enters the bell-shaped portion 432, at least some of the water follows the gradually outwardly sloping wall away from the central axis of the toilet 10C along a first path in a sideways direction. This water is then suddenly splashed towards the center of the trapway 18 along a second path in another sideways direction when it hits the inwardly sloping wall of the bell-shaped portion 432. The redirection of water back towards the center of the trapway 18 results in a brief accumulation of water near the bottom of the bell-shaped portion 432 permits water to collect within the bell-shaped portion 432 to initiate a siphon.

In the various forms described above, different materials may be used to form the components of the toilets and the associated trapways. For example, the bowl and portions of the trapway outside of the wall may be made from a ceramic material or other standard toilet fabrication material to provide a pleasant appearing toilet. The portion of the trapway within the wall or floor may be formed of a ceramic material or a non-ceramic material such as a plastic or metal. It is particularly contemplated that the first path and the second path may be formed in a unitary plastic structure.

Most preferably the trapways described herein don't require significant constriction of the trapway to induce the siphon. Thus, these trapways do not sacrifice cross-sectional flow area to form the siphon, and thus don't increase clogging risk.

Thus, the present invention provides toilets which use less bathroom space, yet don't compromise on toilet performance or require significant extra space behind the room wall. Further, they don't significantly increase production costs.

It should be appreciated that various other modifications and variations to the preferred embodiments can be made within the spirit and scope of the invention. Therefore, the invention should not be limited to the described embodiments. To ascertain the full scope of the invention, the following claims should be referenced.

Industrial Applicability

The invention provides toilets suitable for installation partially behind a room wall and partially in front of it.

We claim:

1. A toilet suitable to be installed through a bathroom wall such that part of the toilet is in front of the bathroom wall and another part of the toilet is behind the bathroom wall, the toilet comprising:

a bowl portion suitable to be positioned in the bathroom in front of the bathroom wall; and a trap having an up leg, a first sideways-extending leg, a down leg, and a second sideways-extending leg;

wherein the up leg extends in an upward direction from an opening of the bowl portion, the first sideways-extending leg extends generally perpendicular from the up leg in a substantially horizontal direction toward a left or right side of the toilet, the down leg extends from the first sideways-extending leg in a downward direction, and the second sideways-extending leg extends from the down leg in a direction generally opposite direction to the first sideways-extending leg; and wherein the first sideways-extending leg, down leg, and second sideways-extending leg are configured to be positioned behind the bathroom wall.

2. The toilet of claim 1, wherein at a down stream end of the second sideways-extending leg is an outlet.

3. The toilet of claim 2, wherein the outlet is centered between the left and right sides of the toilet.

4. A toilet suitable to be installed through a bathroom wall such that part of the toilet is outside of the bathroom wall and another part of the toilet is inside the bathroom wall, the toilet comprising:

a bowl portion suitable to be positioned in the bathroom in front of the bathroom wall; and a trap having an up leg, a down leg, and an out leg;

wherein the up leg extends in an upward direction from an opening of the bowl portion to a weir, the down leg extends from the weir in a downward direction along a central axis of the toilet, and the out leg extends from the down leg in an essentially horizontal direction away from the central axis of the toilet toward a left or right side of the toilet; and wherein at least a portion of the down leg is configured to be positioned above a skirt portion of the bathroom wall and the out leg is configured to be positioned below the skirt portion, the skirt portion being positioned above a floor of the bathroom.

5. The toilet of claim 4, wherein the out leg extends from the down leg at an essentially perpendicular angle.

6. A toilet suitable to be installed through a bathroom wall such that part of the toilet is in front of the bathroom wall and another part of the toilet is behind the bathroom wall, the toilet comprising:

a bowl portion configured to be positioned in front of the bathroom wall; and a trap having an up leg, a down leg, and a bell-shaped portion;

wherein the up leg extends in an upward direction from an opening of the bowl portion to a weir, the down leg extends downward from the weir, and the bell-shaped portion extends downward from the down leg; and wherein bell-shaped portion includes a gradually outward sloping wall and a gradually inwardly sloping wall extending downward from the gradually outward sloping wall.

7. The toilet of claim 6, wherein the outwardly sloping wall is configured to direct water away from a center of the trap, and the inwardly sloping wall is configured to thereafter redirect that water toward the center of the trap.

8. The toilet of claim 7, wherein the outwardly sloping wall is configured such that water follows the outwardly sloping wall away from the center of the trap.

9. The toilet of claim 6, wherein the bell-shaped portion is configured to accumulate water near a bottom portion thereof to initiate a siphon when the toilet is flushed.

10. A toilet suitable to be installed through a bathroom wall such that part of the toilet is in front of the bathroom wall and another part of the toilet is behind the bathroom wall, the toilet comprising:

a bowl portion suitable to be positioned in the bathroom in front of the bathroom wall; and a trap having an up leg, a down leg, and an cross leg;

wherein the out leg extends in an upward direction from an opening of the bowl portion to a weir, the down leg extends in a downward direction toward a left or right side of the toilet from the weir, and the cross leg extends toward the other of the left or right side of the toilet from the down leg past an outlet to a toe;

wherein an upper transition between the down leg and the cross leg is oriented essentially vertically above a transition between the cross leg and the outlet.

11. The toilet of claim 10, wherein a lower transition between the down leg and the cross leg includes a heel portion, the heel portion being configured to direct water from the down leg through the cross leg.

12. The toilet of claim 11, wherein trap is configured to collect water between the heel portion and the toe to seal the trap.

13. The toilet of claim 1, wherein the first sideways-extending leg, and the second sideways-extending leg are configured to extend at least a portion of a distance between two studs of the bathroom wall.

14. The toilet of claim 1, wherein the down leg extends generally perpendicular from the first side-ways extending leg.

15. The toilet of claim 1, wherein the down leg extends in an essentially vertical direction.

16. The toilet of claim 1, wherein the out leg extends generally perpendicular from the down leg.

17. The toilet of claim 1, wherein the out leg extends in an generally horizontal direction.

18. The toilet of claim 1, wherein the out leg includes an upwardly bending portion.

19. The toilet of claim 4, wherein the down leg extends in an essentially vertical direction.

20. The toilet of claim 4, wherein the out leg is slightly inclined from the down leg.

* * * * *